US006290453B1

(12) United States Patent
Corniani et al.

(10) Patent No.: US 6,290,453 B1
(45) Date of Patent: Sep. 18, 2001

(54) UNIT FOR FEEDING FLAT DIECUT BLANKS OF WRAPPING MATERIAL TO A USER MACHINE

(75) Inventors: Carlo Corniani, Marmirolo; Roberto Risi, Casalecchio di Reno; Attilio Maggi, Ponti sul Mincio, all of (IT)

(73) Assignee: Azionaria Costruzioni Macchine Automatiche A.C.M.A. S.p.A., Bologna (IT)

( * ) Notice: Subject to any disclaimer, the term of this patent is extended or adjusted under 35 U.S.C. 154(b) by 0 days.

(21) Appl. No.: 09/347,866

(22) Filed: Jul. 9, 1999

(30) Foreign Application Priority Data

Jul. 10, 1998 (IT) ..... BO98A0423

(51) Int. Cl.[7] ..... B65G 5/99

(52) U.S. Cl. ..... 414/798.9; 414/798.6; 414/798.7; 198/461.1; 198/462.3; 198/688.1; 198/690.2; 271/31.1; 271/150

(58) Field of Search ..... 414/798.9, 798.6, 414/798.7; 198/461.1, 462.3, 688.1, 690.2; 271/31.1, 150, 266, 202, 203

(56) References Cited

U.S. PATENT DOCUMENTS 4,588,180 * 5/1986 Ballestrazzi et al. ..... 271/5
4,697,973 * 10/1987 Hahn et al. ..... 414/330
4,867,432 * 9/1989 Matta ..... 271/9
4,934,682 * 6/1990 Rece et al. ..... 271/3.1
5,026,038 * 6/1991 Weller et al. ..... 271/3.1
5,131,899 * 7/1992 Nagahashi et al. ..... 493/317
5,211,529 5/1993 Esala et al. .
5,829,742 * 11/1998 Rabindran et al. ..... 271/150
5,860,269 1/1999 Takahashi et al. .
6,017,029 * 1/2000 Bates et al. ..... 271/3.12
6,036,186 * 3/2000 Glanzmann et al. ..... 271/150

FOREIGN PATENT DOCUMENTS

3629802 A1 3/1988 (DE) .
537 596 A2 4/1993 (EP) .
816 268 A2 1/1998 (EP) .

* cited by examiner

*Primary Examiner*—Christopher P. Ellis
*Assistant Examiner*—Khoi H. Tran

(57) ABSTRACT

A unit for feeding flat diecut blanks of wrapping material to a user machine is equipped with a conveyor by which blanks disposed on edge transversely to a given feed direction and ordered in a substantially continuous column are caused to advance along a conveying path extending toward a transfer station where each blank in turn is picked up from the column; the conveyor comprises two sections aligned along the path: the one, an intermittently driven first belt by which the column is advanced toward the transfer station through a step of predetermined length, at a predetermined frequency timed with the operation of a pickup mechanism positioned at the transfer station, the other a continuously driven second belt designed to advance the column toward the first belt at a predetermined velocity.

12 Claims, 2 Drawing Sheets

UNIT FOR FEEDING FLAT DIECUT BLANKS OF WRAPPING MATERIAL TO A USER MACHINE

BACKGROUND OF THE INVENTION

The present invention relates to a unit for feeding flat diecut blanks of wrapping material to a user machine.

In particular, the invention relates to a unit by which flat cardboard blanks are fed to a wrapping machine, and reference is made directly in the following specification, albeit with no limitation implied, to cartoner machines for packaging ordered groups of articles such as bottles or other similar containers.

The prior art embraces feed units of the general type comprising an intermittently driven conveyor belt on which flat cardboard blanks ordered in a substantially continuous file or column are caused to advance longitudinally along a rectilinear and substantially horizontal path that extends toward a transfer station where they are taken up singly and in succession from the advancing column by a pickup mechanism. The blanks making up the column are set on edge, lying transversely to the feed direction, and breasted one with another in such a way as to form a compact mass on the conveyor.

In units of the type in question, the conveyor is indexed through a step equivalent to the thickness of a single blank, synchronously with the operation of the pickup mechanism, which in turn is activated cyclically and synchronously with the working parts of the cartoner.

The leading blank of the column, or in effect the blank which at any given moment precedes the others in the feed direction, is engaged at the transfer station by a retaining device serving to maintain the compactness of the column. Generally speaking, the retaining device comprises at least one detent element positioned to interact with a point on the periphery of the blank, whilst the pickup mechanism consists in suction cup means positioned to engage a substantially central portion of the blank. This means that when subjected to the combined action of the detent and the suction pickup mechanism, the blank is caused to flex elastically in such a way that it can slip free of the detent.

The blanks generally are placed on the conveyor in ordered packs by the machine operator.

Accordingly, the storage capacity of the conveyor for a selected operating speed of the machine must be sufficient to ensure that the supply of blanks on the conveyor at any given time is not depleted before the operator has had time to load a new pack.

As the operating speed of cartoners has continued to increase, conveyors of correspondingly larger capacity have continued to be developed: or rather, additional capacity has been gained through the simple expedient of elongating the conveyors along the direction followed by the blanks.

It happens, however, that when a conveyor of the type described above is increased in length this also has the effect of raising the maximum value of inertia-related stresses set up in the structure of the conveyor by the intermittent motion transmitted to the column of blanks. In this type of conveyor, accordingly, increased storage capacity needs to be accompanied by greater strength, which clearly must involve higher construction costs.

The object of the present invention is to provide a feed unit for flat diecut blanks which, compared with those of the prior art, affords a relatively large storage capacity and at the same time will be relatively simple and economical in embodiment.

SUMMARY OF THE INVENTION

The stated object is realized in a unit according to the present invention for feeding flat diecut blanks of wrapping material to a user machine, typically comprising a conveyor assembly by which single blanks disposed on edge transversely to a predetermined feed direction and ordered thus in a substantially continuous column are advanced along a predetermined path extending toward a transfer station at which each blank in turn is picked up from the column, also a pickup mechanism located at the transfer station and operating synchronously with the user machine.

The conveyor assembly comprises a first portion and a second portion, coinciding respectively with a first section and a second section of the path, of which the first portion is driven intermittently in such a way as to advance the column of blanks toward the transfer station through a step of predetermined length at a predetermined frequency timed with the operation of the pickup mechanism, and the second portion is driven continuously in such a way as to advance the column of blanks at a predetermined velocity toward the first portion.

In a preferred embodiment of the invention, the first and second sections constitute a relatively short and a relatively long stretch, respectively, of the conveying path.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
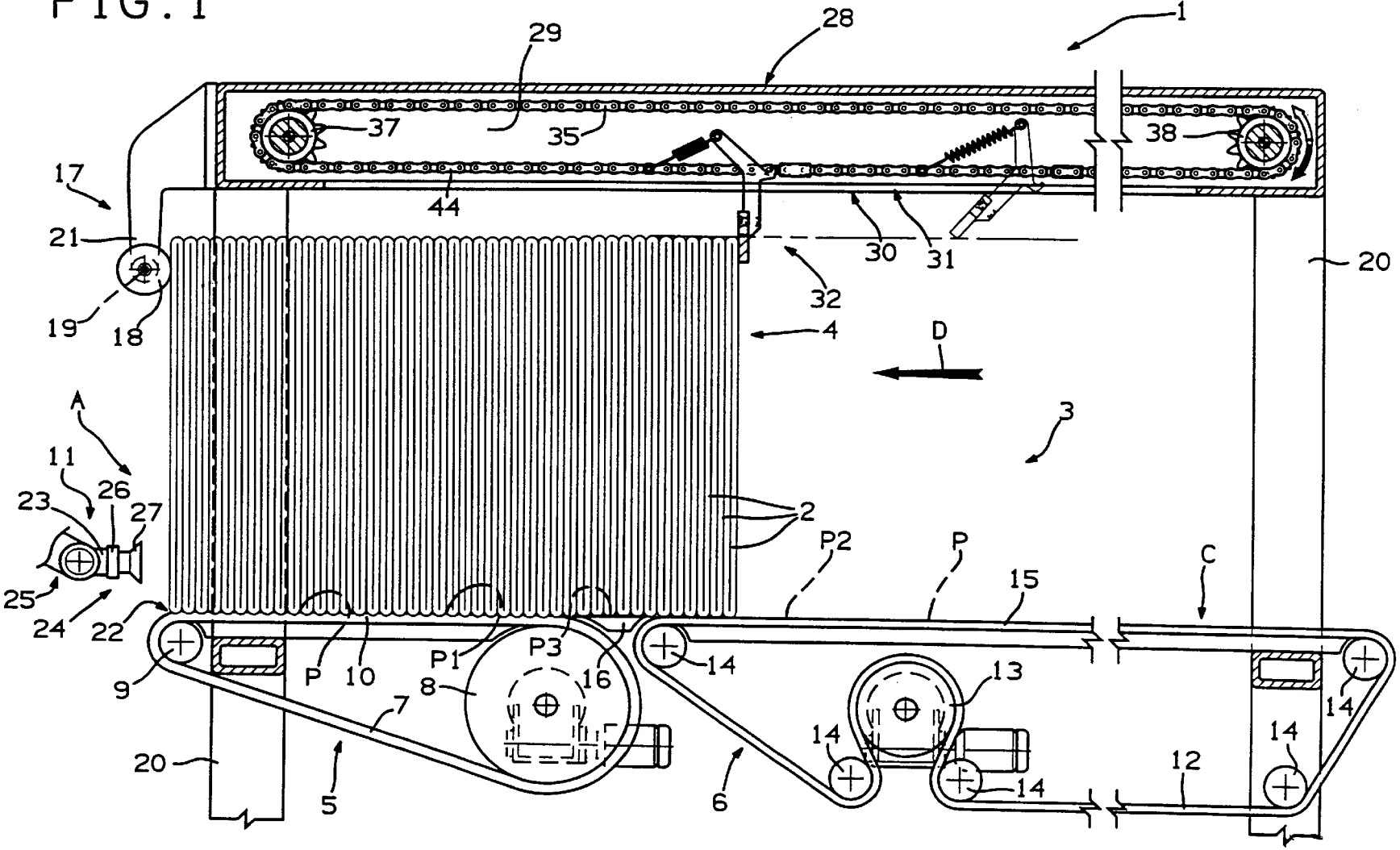
FIG. 1 illustrates a possible embodiment of the feed unit according to the present invention, seen schematically in a side elevation with certain parts in section and certain omitted for clarity.

Referring to FIG. 1 of the drawings, 1 denotes a feed unit, in its entirety, by which flat diecut blanks 2 of cardboard material are supplied to a cartoner machine (conventional in embodiment, and therefore not illustrated) for packaging ordered groups of articles such as bottles or other similar containers.

The feed unit 1 comprises a conveyor assembly 3 by which a substantially continuous file or column 4 of the blanks 2 is advanced longitudinally in a predetermined direction and along a substantially horizontal rectilinear path P extending toward a station A at which each blank 2 is picked up from the column 4. More precisely, the blanks 2 making up the column 4 are disposed on edge, transversely to the feed direction D, and breasted one with the next in such a way as to form a compact mass.

The conveyor assembly 3 comprises a first and a second belt conveyor denoted 5 and 6 respectively, aligned in succession along the conveying path P and coinciding with respective sections of the path denoted P1 and P2. The first section P1 follows the second section P2 along the feed direction D, and the two sections P1 and P2 respectively constitute a relatively short stretch and a relatively long stretch of the path P. In the particular example illustrated, the length of the shorter section P1 is substantially one tenth the length of the longer section P2.

The first conveyor 5 comprises an endless belt 7 looped around a power driven pulley 8 and a freely revolving pulley 9, both of which rotatable about a horizontal axis, and affording an upwardly directed conveying branch 10 that is driven intermittently in such a manner as to advance the column 4 toward the transfer station A through a step S equivalent to the thickness of the blank 2, synchronously with the operation of a pickup mechanism 11 positioned at the station A.

The second conveyor 6 comprises a belt 12 looped around a power driven pulley 13 and a plurality of freely revolving pulleys 14, likewise rotatable about horizontal axes, and affording an upwardly directed conveying branch 15 driven continuously and in such a way as to advance the column 4 toward the first conveyor 5 at a velocity V controlled in conventional manner (not illustrated) according to the frequency at which the intermittently driven belt 7 is indexed. Part of the conveying branch 15 remains exposed laterally and accessible thus to an operator in such a way as to afford an area C along the second section P2 of the path P at which the blanks 2 can be loaded onto the belt 12.

The first and second sections P1, P2 of the path are interconnected by a further section denoted P3, consisting in a horizontal plate 16 located between the two conveyors 5 and 6 and positioned on a level with the relative conveying branches 10 and 15. The third section P3 extends along the path P through a distance that is negligible in comparison with the length of the interconnected branches 10 and 15.

The feed unit 1 further comprises an element 17 positioned above the end of the first conveying branch 10 directed toward the transfer station A and serving to retain the column 4 of blanks 2. The element 17 in question consists substantially in a detent roller 18, freely rotatable about an axis 19 disposed horizontally and transversely to the feed direction D, which is mounted to an arm 21 carried by a fixed frame 20 and positioned in such a way as to engage each successive blank 2 of the column 4 advancing along the first belt 7, making contact with the edge remote from the edge resting on the belt.

The belt 7 is fashioned from a relatively soft flexible material so that, during operation, the column 4 will sink into the conveying branch 10 by an amount sufficient to create a lip 22 immediately preceding the blank positioned forwardmost in the feed direction D, with the result that this same leading blank 2 of the column 4 is restrained along the edge resting on the belt 7.

The pickup mechanism 11 incorporates a motorized arm 23 of which one free end carries a rigidly associated gripping element 24 and the opposite end is connected to a conventional actuating device 25 such as will invest the element 24 cyclically with movement away from and toward a pickup position, synchronously with the components of the cartoner (not illustrated).

The gripping element 24 comprises a plate 26 of which the longitudinal dimension, measured in a direction transverse to the feed direction D, is substantially equal to the width of the conveying branch 10, and a plurality of suction cups 27 (one only of which is visible in FIG. 1) carried by the plate 26, which are arranged in a row and connected to a conventional vacuum device not illustrated in the drawings.

In operation, the suction cups 27 will engage the blank 2 nearest the transfer station A along a line adjacent to the edge retained by the lip 22.

The column 4 is prevented from collapsing during operation by a steadying device 28, also forming part of the feed unit 1, which ensures that the blanks 2 do not fall backwards when advanced along the feed direction D.

The steadying device 28 affords a tubular beam 29 of rectangular section supported by the frame 20, located above the conveyor assembly 3 and extending longitudinally along the feed direction D, of which one horizontal face 30 directed downward toward the conveyor assembly 3 affords a longitudinal slot 31 slidably accommodating a movable steadying element 32 designed to engage the rearwardmost blank 2 of the column 4 along the edge nearest the beam 29. More exactly, the slot 31 extends parallel to the conveying path P essentially in vertical alignment with the median axis of the conveying branches 10 and 15 and the plate 16.

Figure 2:
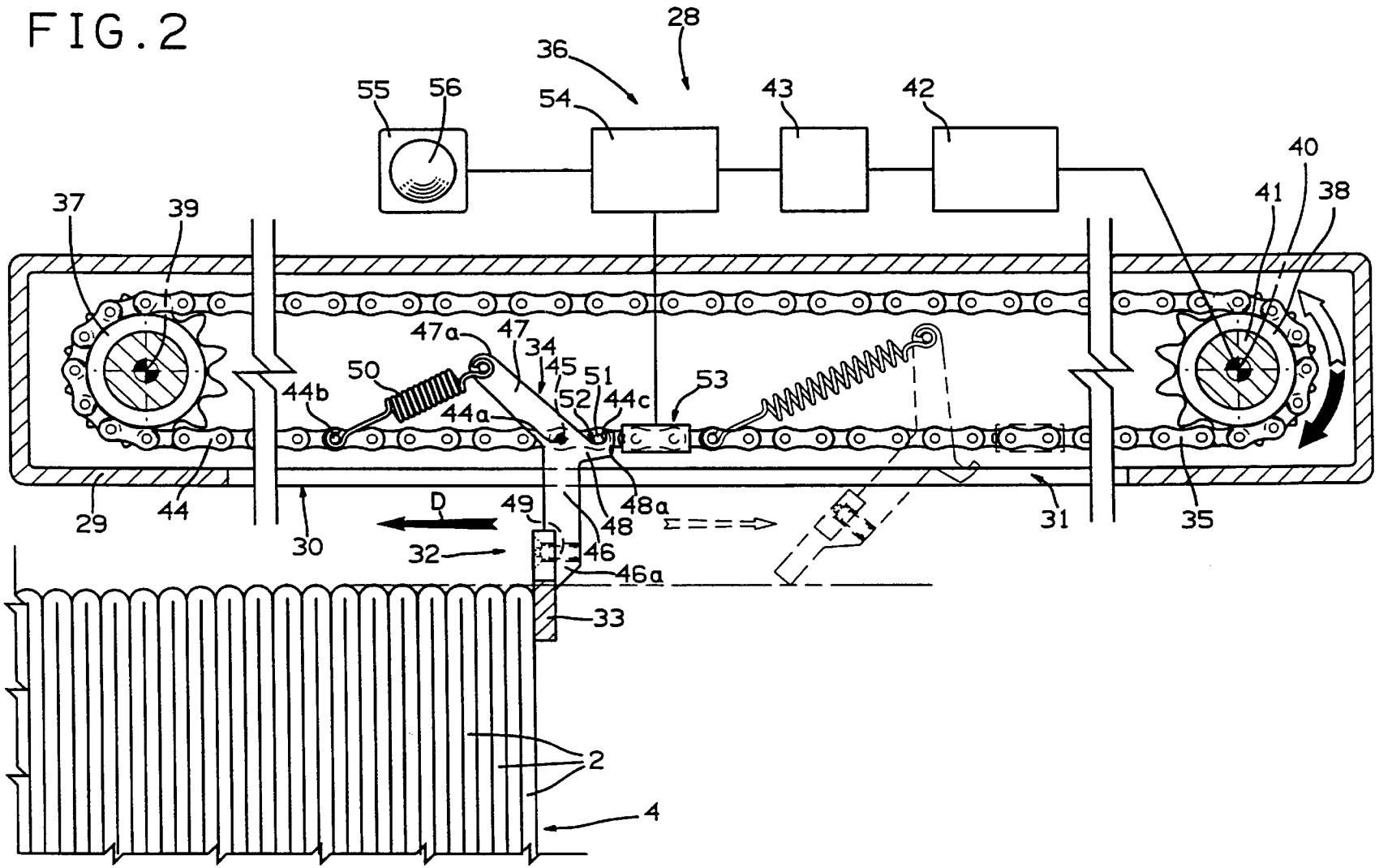
FIG. 2 illustrates an enlarged detail of the feed unit shown in FIG. 1, seen schematically in a side elevation with certain parts in section and certain omitted for clarity.

As discernible in FIG. 2, the steadying element 32 comprises a plate 33 extending transversely to the feed direction D, by which the rearwardmost blank 2 of the column 4 is accompanied along the conveying path P, and an element 34 serving to support the plate 33, disposed transversely to the plate and accommodated slidably by the slot 31.

The support element 34 is connected to a chain 35 occupying the void of the tubular beam 29 in such a way that it can be caused by means of a controller device 36 to advance along the feed direction D and to retract, as will be explained in due course, in the direction opposite to the feed direction D.

The chain 35 is looped over a pair of sprockets 37 and 38 rotatable about respective axes 39 and 40 extending horizontally and transversely to the feed direction D. The one sprocket 37 revolves freely about the corresponding axis 39 of rotation, whilst the remaining sprocket 38 is keyed coaxially to a shaft 41 coupled by way of a torque limiter 42 to a reversible drive unit 43 constituting an actuator element of the aforementioned controller device 36.

The sprockets 37, 38 and the chain 35 combine to establish a bottom branch 44 with which the support element 34 is pivotably associated in the manner of a rocker and rotatable about an axis 45 parallel to the two sprocket axes 39 and 40. More exactly, the support element 34 is pivotably associated with an extension afforded by one of the link pins 44*a* of the branch 44.

The support element 34 presents three arms 46, 47 and 48 radiating substantially in a Tee formation from the pivot axis 45. A first arm 46 is secured at one end 46*a* to the plate 33 by means of fixing screws 49; a second arm 47 is located on the side of the pivot axis 45 opposite to the first arm 46 and connected at one end 47*a* by way of a spring 50 to an extension afforded by a link pin 44*b* in the branch 44 of the chain lying beyond the pin 44*a* first mentioned, relative to the feed direction D; the remaining arm 48 extends from the first two arms 46 and 47, in such a way substantially as to form a Tee, and affords a free end 48*a* positioned to engage a peg 51 with which it is maintained in association through the agency of the spring 50. The peg 51 is afforded by the extension of a link pin 44*c* in the branch 44 of the chain immediately preceding the first pin 44*a*, relative to the feed direction D, and in effect the two pins denoted 44*a* and 44*c* are associated with one and the same link of the chain 35.

The spring 50 remains sufficiently tensioned when in the relaxed condition to ensure that the support element 34 tends to rotate about the pivot axis 45 (counterclockwise as viewed in FIG. 2), with the result that a leading edge 52 afforded by the end 48*a* of the aforementioned arm 48 will lock stably behind the peg 51, whilst the geometry of the element 34 itself ensures that when the peg 51 and the edge 52 are in engagement, the plate 33 will be disposed in a substantially vertical position.

The length of the restrained arm 48 approximately equals that of one link in the chain 35, and the end 48*a* is L-shaped in such a way that when engaged by the peg 51 it can be detected by a sensor 53 mounted to two pins of a link in the branch 44 and occupying a position facing the peg 51, on the side remote from the support element 34.

The sensor 53 is coupled to a processing unit 54 of the controller device 36 and will relay a signal to enable the movement of the branch 44 along the feed direction D whenever the leading edge 52 of the arm 48 is engaged by the peg 51. Besides being connected to the sensor 53, the processing unit 54 is connected to a generator 55 which the operator of the machine can activate, by pressing a relative button 56, to produce a signal that will enable the movement of the branch 44 in the direction opposite to the feed direction D. The speed of rotation of the drive unit 43 is determined at any given moment by the processing unit 54 according to a resident program and on the basis of information relating to the velocity V of the second conveyor 6 that will be received by the unit 54 in conventional manner (not illustrated).

In operation, each blank 2 making up the column 4 passes along the three consecutive sections P2, P3 and P1 of the conveying path P, following the feed direction D, advancing continuously at a selected velocity V along the first two sections P2 and P3, then intermittently by discrete steps S along the final section P1. The combined operation of the two conveyors 5 and 6 will be obvious to a person with ordinary skill in the art and requires no further explanation.

As the column 4 moves along the path P, the blank bringing up the rear continues to be engaged by the plate 33 of the movable steadying element 32, which is caused by the processing unit 54, and through the agency of the torque limiter 42, to advance continuously at the aforementioned velocity V in the feed direction D. In this configuration, the edge 52 afforded by the end 48*a* of the arm 48 is engaged by the peg 51 and the plate 33 remains in the substantially vertical position, so that the rearwardmost blank 2 of the advancing column will be accompanied along the feed direction D and thus prevented from falling backwards.

On reaching the transfer station A, each single blank 2 is engaged by the pickup mechanism 11 along the bottom edge and separated from the column 4. The combined operation of the pickup mechanism 11 and the first conveyor 5 will be obvious from the foregoing description to a person with ordinary skill in the art and needs no further explanation. Conversely, it may usefully be noted that during a brief interval of time immediately following the moment in which the leading blank 2 of the column 4 is freed from the lip 22 and immediately preceding the moment in which this same blank 2 disengages from the roller 18, a new lip 22 is formed thanks to the elastic properties of the belt 7, retaining the next blank 2 of the column 4 straight away and ensuring that the column 4 will not lose shape each time the forwardmost blank 2 is separated.

The second conveyor 6 is replenished regularly by the operator of the machine with packs of blanks 2, which are loaded onto the conveying branch 15 at the area denoted C in a direction transverse to the feed direction D.

After loading each pack of blanks 2, the operator holds the pack in place and presses the button 56 to reverse the bottom branch 44 of the chain 35, with the result that the plate 33 is caused to move in the direction opposite to the feed direction D. When the plate 33 encounters the leading blank 2 of the newly loaded pack, the support element 34 will rotate about the pivot axis 45 clockwise, as viewed in FIG. 2, defeating the force of the spring 50. The plate 33 now rides along the pack until past the rearwardmost blank 2, returning thereupon to the substantially vertical position. At this point, the sensor 53 sends a signal to the processing unit 54, the movement of the branch 44 is inverted, and the plate 33 begins moving once again along the feed direction D toward the newly loaded pack of blanks. The plate 33 advances along the feed direction D unimpeded during this step, moving at a velocity V1 greater than the velocity V of the belt 12, whilst the newly loaded pack of blanks 2 will be pushed by the operator along the feed direction D and into contact with the column 4. As the plate 33 engages the rearwardmost blank 2 of the newly loaded pack, the torque limiter 42 cuts in and the plate 33 will continue to advance along the feed direction D at the same velocity V as the belt 12. At this point, the operator can leave the newly loaded blanks 2 to advance unassisted.

In an alternative embodiment of the feed unit not illustrated in the drawings, the enabling signal that allows the movement of the branch 44 in the direction opposite to the feed direction D might be generated automatically by sensors of conventional type located strategically in the loading area C and connected to the processing unit 54.

Finally, in a further embodiment of the feed unit likewise not illustrated, the beam 29 could extend parallel to the feed path P only through a distance corresponding to the length of the second and the third sections P2 and P3, whilst the area above the first section P1 might be occupied by an auxiliary conveyor appearing substantially identical to the first conveyor 5 and separated from the relative conveying branch 10 by a distance marginally less than the height of the blanks 2 resting thereon. Thus, whatever the weight of the column 4 of blanks bearing on the conveyor 5, the resulting pressure of the auxiliary conveyor will ensure that a lip 22 is formed in the conveying branch 10, and with the formation also of a retaining lip in the auxiliary conveyor, identical in every respect to the lip 22 illustrated, the roller 18 could be eliminated.

What is claimed is:

1. A unit for feeding flat diecut blanks of wrapping material to a user machine, the unit comprising:

a conveyor assembly by which single blanks disposed on edge transversely to a predetermined feed direction and ordered thus in a substantially continuous column are advanced along a predetermined path, said conveyor assembly including first conveyor means and second conveyor means, the first conveyor means being disposed following the second conveyor means along said path;

a transfer station located downstream along said path where each blank in turn is picked up from the column;

a pickup mechanism located at the transfer station and operating synchronously with the user machine;

the first conveyor means and second conveyor means coinciding respectively with a first section and a second section of the path, of which the first conveyor means are driven intermittently for advancing the column of blanks toward the transfer station through a step of predetermined length at a predetermined frequency timed with the operation of the pickup mechanism, and the second conveyor means are driven continuously for advancing the column of blanks at a predetermined velocity toward the first conveyor means;

wherein the first conveyor means comprise at least one belt fashioned from a relatively soft flexible material which is deformable by said blanks, said blanks creating at least one lip on said belt in the neighbourhood of the transfer station whereby said lip retains a forwardmost blank of the column.

2. A unit as in claim 1, wherein the first and second sections of the predetermined path constitute a relatively short section and a relatively long section, respectively, of the selfsame path.

3. A unit as in claim 1 or claim 2, wherein the path followed by the column of blanks is rectilinear and substantially horizontal.

4. A unit as in claim 3, comprising fixed retaining means positioned at the transfer station and serving to engage the forwardmost blank of the column, said retaining means including a roller which is positioned above the end of the first conveyor means directed toward said transfer station and engages the forwardmost blank of the column, making contact with the edge of said blank remote from the edge resting on said first conveyor means; said pickup mechanism being located at the transfer station in the neighbourhood of said edge resting on said conveyor means.

5. A unit as in claim 3, comprising steadying means for engaging a rearwardmost blank of the column, said steadying means including a steadying element and third conveyor means by which the steadying element is made to effect a first predetermined movement along the feed direction at the same velocity as the second conveyor means and maintained in a predetermined position of engagement with the rearwardmost blank of the column, wherein the steadying element is made by the third conveyor means to effect a second predetermined movement in a direction opposite to the feed direction.

6. A unit as in claim 5, wherein the steadying element is pivotably associated with the third conveyor means, rotatable thus about a horizontal axis extending transversely to the predetermined path, and comprises a portion designed to engage the rearwardmost blank and capable of movement between predetermined first and second angular positions, of which the first angular position is the position of engagement.

7. A unit as in claim 6, wherein the steadying means comprise spring means, and restraint means rigidly associated with the third conveyor means, designed to operate one in conjunction with another in such a manner as to define the first angular position and allow the steadying element a predetermined measure of rotation about the pivot axis from the first angular position to the second angular position.

8. A unit as in claim 7, wherein the operation of the third conveyor means is governed by controller means forming part of the steadying means and comprising a processing unit controlling the movement of the third conveyor means, a first monitoring stage from which a signal is supplied to the processing unit to enable the first pre-determined movement, and a second monitoring stage from which a signal is supplied to the processing unit to enable the second predetermined movement.

9. A unit as in claim 8, wherein the first monitoring stage comprises a sensor by means of which to detect the first angular position.

10. A unit as in claim 8, wherein the second monitoring stage can be activated by an operator.

11. A unit as in claim 5, wherein the steadying means comprise a torque limiter associated with the third conveyor means, through the agency of which the steadying element is made to effect the first predetermined movement at a velocity matching the velocity of the second conveyor means.

12. A unit for feeding flat diecut blanks of wrapping material to a user machine, the unit comprising:

a conveyor assembly, single blanks disposed on edge transversely to a predetermined feed direction and ordered thus in a substantially continuous column being advanced along a predetermined path along the conveyor assembly, said conveyor assembly including, in order along the path, a first conveyor and a second conveyor;

a transfer station located downstream along the path, each blank of the column being picked up at the transfer station, in turn;

a pickup mechanism located at the transfer station and operating synchronously with the user machine;

the first and second conveyors coinciding respectively with a first and second section of the path, of which the first conveyor is driven intermittently to advance the column of blanks toward the transfer station through a step of predetermined length at a predetermined frequency timed with the operation of the pickup mechanism, and the second conveyor is driven continuously to advance the column of blanks at a predetermined velocity toward the first conveyor;

wherein the first conveyor comprises at least one belt comprising a relatively soft flexible material which is deformable by the blanks, the blanks creating at least one lip on the belt in the neighbourhood of the transfer station whereby the lip retains a forwardmost blank of the column.

* * * * *